US011105192B1

(12) United States Patent
Russell et al.

(10) Patent No.: US 11,105,192 B1
(45) Date of Patent: Aug. 31, 2021

(54) VARIABLE BUILD MOTOR

(71) Applicant: Arrival Oil Tools, Inc., Leduc (CA)

(72) Inventors: Jayson Russell, Calgary (CA); Mike Crowther, Carlisle (GB); Laurier Emile Comeau, Calgary (CA)

(73) Assignee: Arrival Oil Tools, Inc., Calgary (CA)

( * ) Notice: Subject to any disclaimer, the term of this patent is extended or adjusted under 35 U.S.C. 154(b) by 0 days.

(21) Appl. No.: 16/795,444

(22) Filed: Feb. 19, 2020

(51) Int. Cl.
*E21B 7/06* (2006.01)
*E21B 44/00* (2006.01)

(52) U.S. Cl.
CPC ..... *E21B 44/005* (2013.01); *E21B 7/064* (2013.01); *E21B 7/068* (2013.01)

(58) Field of Classification Search
CPC ..... E21B 44/005; E21B 7/064; E21B 7/068
See application file for complete search history.

(56) References Cited

U.S. PATENT DOCUMENTS

2006/0243487 A1 11/2006 Turner et al.
2009/0173541 A1* 7/2009 Tulloch ..... E21B 7/04 175/45
2012/0273224 A1* 11/2012 Konschuh ..... E21B 34/066 166/373
2014/0332271 A1* 11/2014 Do ..... E21B 10/62 175/57
2018/0094490 A1 4/2018 Lines et al.
2018/0128060 A1* 5/2018 Haugvaldstad ..... E21B 7/06
2018/0252088 A1* 9/2018 Tilley ..... E21B 47/024
2018/0340374 A1* 11/2018 Moore ..... E21B 7/062

OTHER PUBLICATIONS

Schlumberger, "Power Drive Orbit Rotary Steerable System," 2019, 1 page.
Weatherford, "Magnus Rotary Steerable System," 2019, 1 page.

* cited by examiner

*Primary Examiner* — Taras P Bemko
(74) *Attorney, Agent, or Firm* — Schafer IP Law

(57) ABSTRACT

A variable build motor downhole tool allows changing the build rate in a directional drilling operation without pulling the drill string from the hole and replacing a fixed build sub in the drill string. A pad can be extended upon command to increase the build rate and retracted upon command to decrease the build rate. The pad is mounted on an insert disposed within an outer housing and extends outwardly through the outer housing by action of one or more pistons. Electronics housed in the variable build motor tool are used to receive commands from uphole and cause the pistons to extend, forcing the pad outward to increase the build rate.

18 Claims, 8 Drawing Sheets

VARIABLE BUILD MOTOR

TECHNICAL FIELD

The present invention relates to the field of directional drilling, and in particular to a downhole tool for controlling the build of drilling apparatus.

BACKGROUND ART

Directional drilling involves controlling the direction of a wellbore as it is being drilled. Directional drilling typically utilizes a combination of three basic techniques, each of which presents its own special features. First, the entire drill string may be rotated from the surface, which in turn rotates a drilling bit connected to the end of the drill string. This technique, sometimes called "rotary drilling," is commonly used in non-directional drilling and in directional drilling where no change in direction during the drilling process is required or intended. Second, the drill bit may be rotated by a downhole motor that is powered, for example, by the circulation of fluid supplied from the surface. This technique, sometimes called "slide drilling," is typically used in directional drilling to effect a change in direction of a wellbore, such as in the building of an angle of deflection, and almost always involves the use of specialized equipment in addition to the downhole drilling motor. Third, rotation of the drill string may be superimposed upon rotation of the drilling bit by the downhole motor. Additionally, a new method of directional drilling has emerged which provides steering capability while rotating the drill string, referred to as a rotary steerable system.

The most common way to directional drill is through the use of a bend near the bit in a downhole steerable mud motor. Directional drilling is accomplished with the alternating combination of two drilling operations. In the sliding mode, the drill string is slowly rotated to orient the bend in the desired direction so that the bend points the bit in a direction different from the axis of the wellbore. Once oriented, the bit turns by pumping mud through the mud motor, while the drill string does not rotate but rather slides, allowing the bit to drill in the direction it points. When a particular wellbore direction is achieved, that direction may be maintained by rotating the entire drill string so that the bit does not drill in a single direction off the wellbore axis, but instead sweeps around and its net direction coincides with the existing wellbore.

This technique has required operators to maintain an inventory of downhole tools with different bend angles to accommodate different amounts of "build rate" while drilling. In directional drilling, higher build motors allow for more rapid changes in the direction of the wellbore. However, higher build rates can result in higher loads on the drill string, due to increased doglegs and more severe wellbore spiraling. Further, large bend angle motors experience larger lateral loads while rotating and as such pipe fatigue becomes a concern. A too small bend angle limits the driller's ability to follow a planned well path or to make corrections when deviations occur. Changing the bend angle would require pulling the bottom hole assembly and refitting with a new downhole tool with a different amount of bend, which is a costly and time-consuming project.

The subject matter of the present disclosure is directed to overcoming, or at least reducing the effects of, one or more of the problems outlined above.

SUMMARY OF INVENTION

In one aspect, a downhole tool for use in directional drilling comprises an outer housing having an opening; an insert disposed within the outer housing, comprising: a piston; and a pad disposed radially outward of the piston, wherein extension of the piston urges the pad outward through the opening of the outer housing for engagement with a wellbore and increasing build rate while drilling; an electric motor, configured to cause extension of the piston; and circuitry configured to control the electric motor upon receipt of a command received from uphole.

In another aspect, a method of changing build rate while directionally drilling comprises receiving by a downhole tool a first command to increase build rate from uphole; extending a pad outward from the downhole tool responsive to the first command; and engaging the pad with a wellbore.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings.

DESCRIPTION OF EMBODIMENTS

Figure 1:
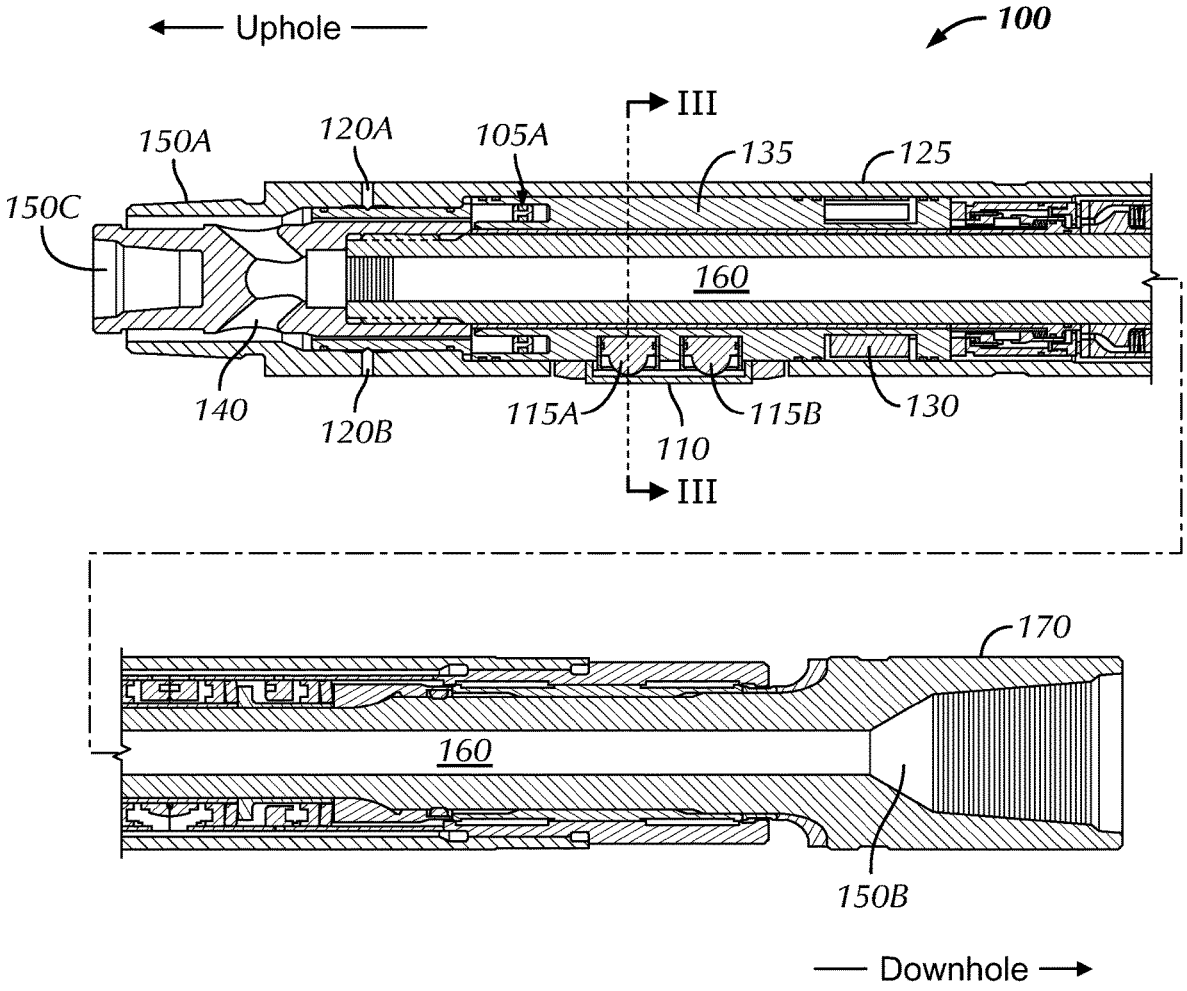
FIGS. 1-2 are plan views of a variable build motor downhole tool according to one embodiment.

In the following description, for purposes of explanation, numerous specific details are set forth in order to provide a thorough understanding of the invention. It will be apparent, however, to one skilled in the art that the invention may be practiced without these specific details. In other instances, structure and devices may be shown in block diagram form in order to avoid obscuring the invention. References to numbers without subscripts are understood to reference all instance of subscripts corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

The terms "a," "an," and "the" are not intended to refer to a singular entity unless explicitly so defined, but include the general class of which a specific example may be used for illustration. The use of the terms "a" or "an" may therefore mean any number that is at least one, including "one," "one or more," "at least one," and "one or more than one."

The term "or" means any of the alternatives and any combination of the alternatives, including all of the alternatives, unless the alternatives are explicitly indicated as mutually exclusive.

The phrase "at least one of" when combined with a list of items, means a single item from the list or any combination of items in the list. The phrase does not require all of the listed items unless explicitly so defined.

In this description, the term "couple" or "couples" means either an indirect or direct connection. Thus, if a first device couples to a second device, that connection may be through a direct connection or through an indirect connection via other devices and connections. The recitation "based on" means "based at least in part on." Therefore, if X is based on Y, X may be a function of Y and any number of other factors.

In describing various locations relative to the Figures the term "downhole" refers to the direction along the axis of the wellbore that looks toward the furthest extent of the wellbore. Downhole is also the direction toward the drill bit location. Similarly, the term "lower end" refers to the portion of the assembly located at the downhole end of the respective assembly. The term "uphole" refers to the direction along the axis of the wellbore that leads back to the surface, or away from the drill bit. Similarly, the term "upper end" refers to the portion of the assembly located at the uphole end of the respective assembly. The term "clockwise" refers to rotation to the right as seen looking downhole and the term "counterclockwise" refers to rotation to the left as seen looking downhole. In a situation where the drilling is more or less along a vertical path, downhole is truly in the down direction, and uphole is truly in the up direction. However, in horizontal drilling, the terms up and down are ambiguous, so the terms downhole and uphole are necessary to designate relative positions along the drill string.

By providing a downhole tool that can alternately extend a pad outward from the tool and retract the pad inward to the tool, a variable build downhole tool allows changing the build rate while directional drilling without the delays, cost, and risks involved in pulling fixed build tools from the wellbore. By extending a pad near the bend point, the lateral forces on the bit are increased, thereby increasing the build rate.

Beginning with FIG. 1, a plan view illustrates a downhole tool that is a variable build motor tool 100 according to one embodiment. An insert 135 is disposed within an outer housing 125 to form the variable build motor tool. Screws 120A and 120B may be used to hold the insert 135 in place in the outer housing 125. Conventional threaded couplings 150A, 150B, and 150C may be used to allow connecting the variable build motor tool 100 to a drill string; alternatively, any other desired technique for coupling a downhole tool in a drill string may be used. Inlet ports 140 allow fluid flow through the bore 160 of the variable build motor tool 100.

In this embodiment, a pad 110 is mounted on the insert 145 through an opening in the outer housing 125. The pad may be made of a suitable steel for use downhole with a surface application of wear-resistant material such as carbide hardfacing, carbide tiles, thermally stable polycrystalline (TSP) diamond, or some combination known to the industry to reduce abrasion effects of contact with the borehole. In operation, the pad 110 may be extended outward from the insert 145 to increase the build rate and retracted inward to decrease the build rate. One or more pistons 115 may be used to push the pad 110 outwardly, causing the build rate to increase when in operation. As illustrated in FIG. 1, two pistons 115A and 115B are used, but any desired number of pistons 115 may be used. Operation of the pistons 115 may be controlled by an onboard electrical motor system that is configured to cause extension of the pistons 115, responsive to receiving a command from uphole. The onboard electrical motor system is described in more detail below. A battery pack 130 may be used to power the onboard electrical motor system, as described in more detail below.

The amount of extension of the pad 110 may be any desired amount, although the amount of extension is typically small, such as approximately ⅝ inch. By extending the pad 110 to engage with a wellbore wall, the build rate of the variable build motor tool 100 may be increased. When the pad 110 is retracted, the build rate may be decreased. By changing the build rate, the rate of change of the curvature of the wellbore being drilled may be correspondingly changed.

In one embodiment, pressure pulses in the drilling fluid may be used to send a command to the variable build motor tool 100 to change the position of the pad 110, causing an increase or decrease in the build rate of the variable build motor tool 100. Any desired pressure change or series of pressure changes may be used, preferably one that would not occur during ordinary operation while drilling. A pressure sensor (not illustrated in the Figures) may be used to detect the pressure pulses by the variable build motor tool 100's onboard electrical system.

Alternately, or in combination with the pressure pulses, a change in rotation or a sequence of changes in rotation may be used as an indication of a command. For example, in one embodiment to cause the pad 110 to extend outwardly, the drill string may be rotated at a static rotational speed, such as 30 rpm. An example command may comprise causing rotation to be stopped for 5 seconds, then rotation to be restarted at 10 rpm. In such an embodiment, an accelerometer or other device for detecting rotation or changes in rotation may be included in the onboard electrical control system. As with use of pressure changes as a command signal, the rotational changes used to command extension of the pad 110 preferably are a sequence of rotation changes not likely to occur in normal operational drilling practice.

In one embodiment, while the pad 110 is being extended, pumping drilling fluid through the well bore may be stopped or reduced, to reduce the amount of force needed for electric motor 215 to adjust a valve 205 in order to energize the pistons 115. The pistons 115 are energized based off of the differential pressure between bore-side and annulus-side, created by the pressure drop across the motor 215. After the pad 110 has extended, pumping of drilling fluid may be restarted or brought back to the normal pressure. The balance pistons 105, also known as an energizing piston, is used to balance pressure on the uphole and downhole side of the balance piston 105 to accommodate the change in volume of drilling fluid being pumped downhole.

As illustrated in FIG. 1, one or more balance pistons 105 pressurized by the drilling fluid in the drill string may be used to ensure balanced pressure on both sides of the balance piston 105. Pressure from drilling fluid on the uphole side of the balance pistons 105 pressurizes oil on the downhole side of the balance pistons 105 that is used for pushing the pistons 115 outward to extend the pad 110. Under no or low fluid pressure, the pad 110 is loaded by the weight of the variable build motor tool 100, pushing fluid back by the pistons 115 and allowing retraction of the pad 110.

Figure 2:
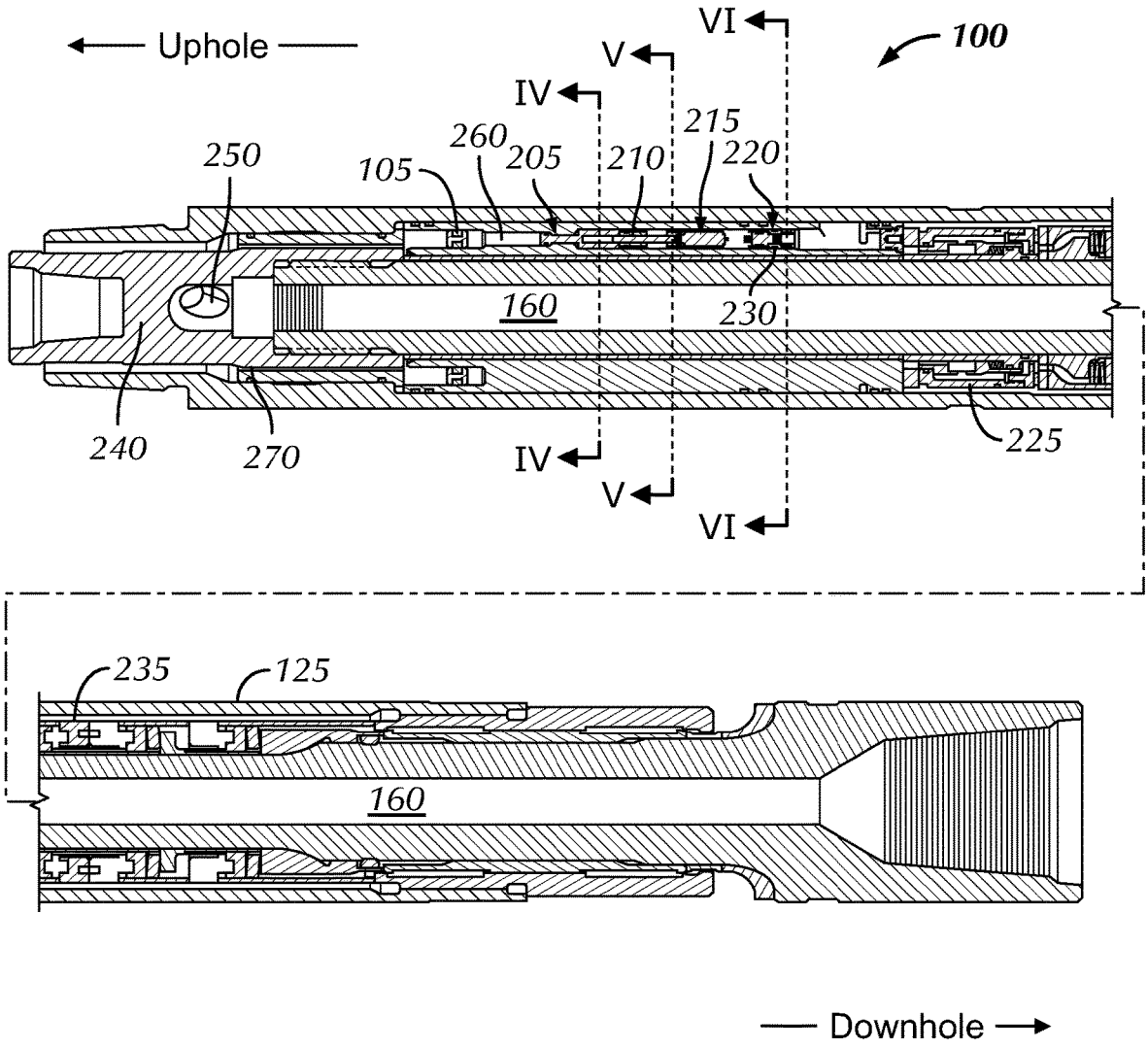

FIG. 2 is a plan view at a different rotational angle of the variable build motor tool 100, allowing other features to be visible in the drawing. Piston 205 is a sealing piston, which may be driven by ball screw assembly 210. The ball screw assembly 210 turns axial movement of a shaft driven by electric motor 215 into axial movement of the piston 205. Changes to the position of piston 205 are preferably performed with pumps off, so that the pistons 115 may retract prior to the electric motor 215 moving the piston 205. When piston 205 is in the illustrated position, bore pressure is applied to the pad pistons 115, extending the pad 110 and increasing the build rate. When piston 205 is retracted (to the right in FIG. 2) bore pressure is sealed off from the pad pistons 115, preventing the oil in the oil chamber 260 from reaching the pad pistons 115, keeping the pad 110 retracted and reducing the build rate.

The sealing piston 205 is positioned by electric motor 215. When piston is in the position illustrated in FIG. 2, bore pressure is applied to pad piston 115, extending pad 110. To retract pistons 115, pumping may be stopped at the surface, reducing the pressure on the pistons 115, such that the weight of the variable build motor tool 100 pushes pistons 115 into their housing. After a set delay, the electric motor 215 may be used to pull the sealing piston 205 into the closed or retracted position. When the pumps are turned back on, the oil is prevented from energizing the pad pistons 115, keeping the variable build motor tool 100 in a less aggressive mode with a lower build rate.

Ball screw assembly 210 may be driven by an electric motor 215, typically a brushless direct current motor or a stepper motor, although other types of motors may be used. The use of a ball screw assembly is illustrative and by way of example only, and any other type of piston mechanism may be driven by the electric motor 215. Other means of moving sealing piston 205, such as a solenoid may be used in place of an electric motor 215. A sealed bulkhead 220 may be provided to allow wires to carry power and control signals from the battery pack 130 and other electronics which are disposed behind the bulkhead 220, with wires (omitted from the drawing for clarity) traversing the bulkhead 220. A bulkhead carrier 230 may be used for mounting the bulkhead in place. The bulkhead 220 prevents electronics and batteries from being exposed to pressure.

Flow diverter 240 is provided to allow drilling fluid to traverse the bore 160. The flow diverter 240 is configured to provide a designed pressure drop in the bore 160. Inlets 140 are formed in the uphole end of flow diverter 240 (sometimes referred to as a driveshaft cap, since it is used for driving driveshaft 170). Fluid flows through opening 250 into bore 160 as constrained by the size of the opening 250. The flow diverter 240 may be slotted with slot 270 to ensure pressure transmission to the balance piston(s) 105.

A mud motor 235 may be provided to support radial and thrust weight of a further downhole drill bit onto the outer housing. As mud motors are well known in the art, no further description of the mud motor 235 should be required for the person of ordinary skill in the art. A flow restrictor 225 may be used to limit mud flow through the bearings of the mud motor 235 and to ensure there is enough pressure available to actuate pad pistons 115.

Figure 3:
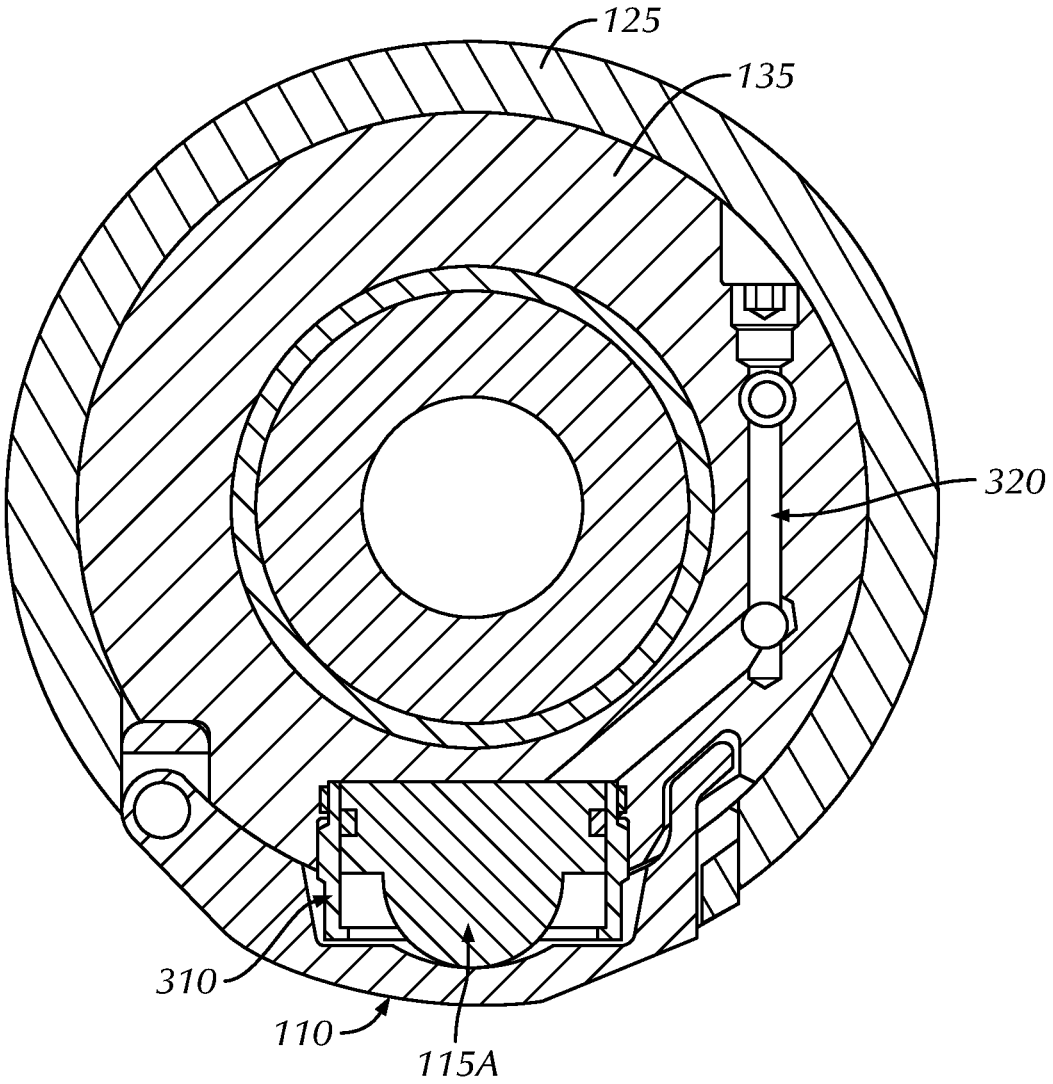
FIGS. 3-6 are cross-sectional views at multiple points along the variable build motor down hole tool according to one embodiment.
Figure 4:
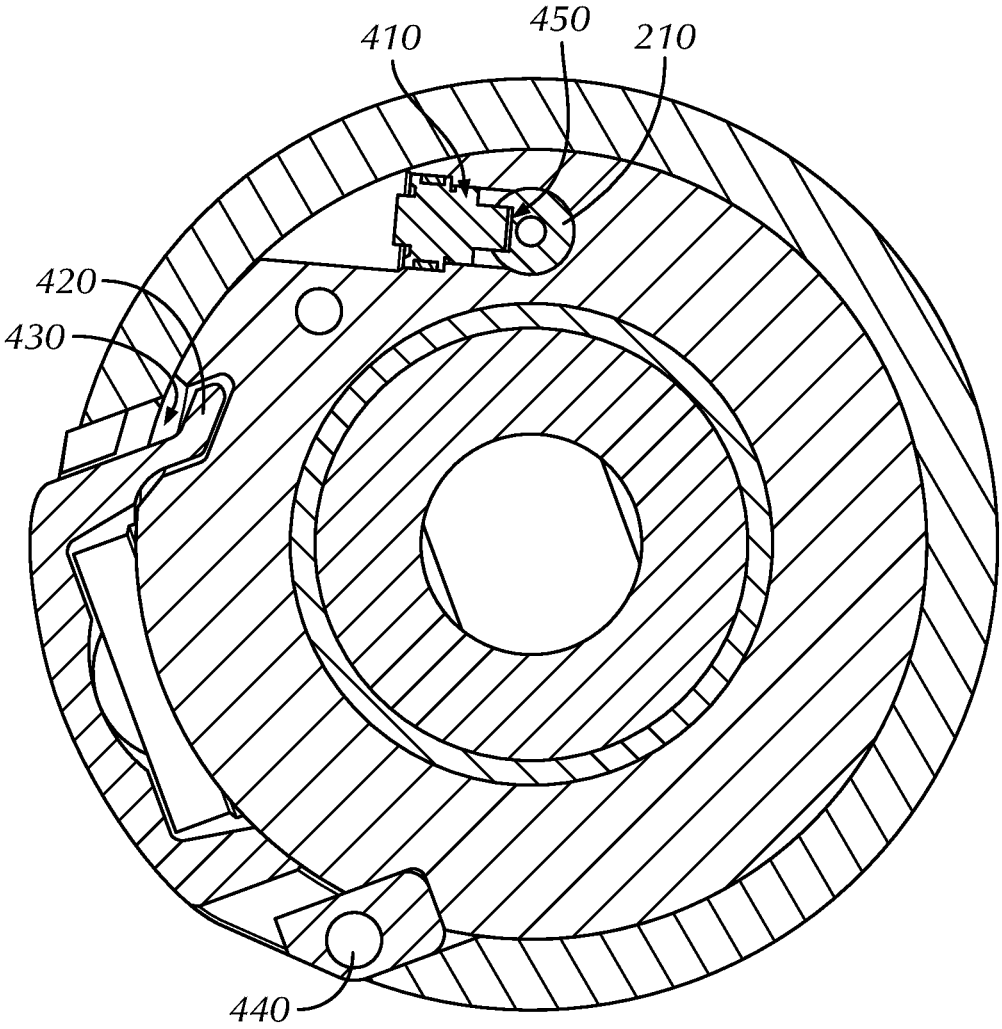
Figure 5:
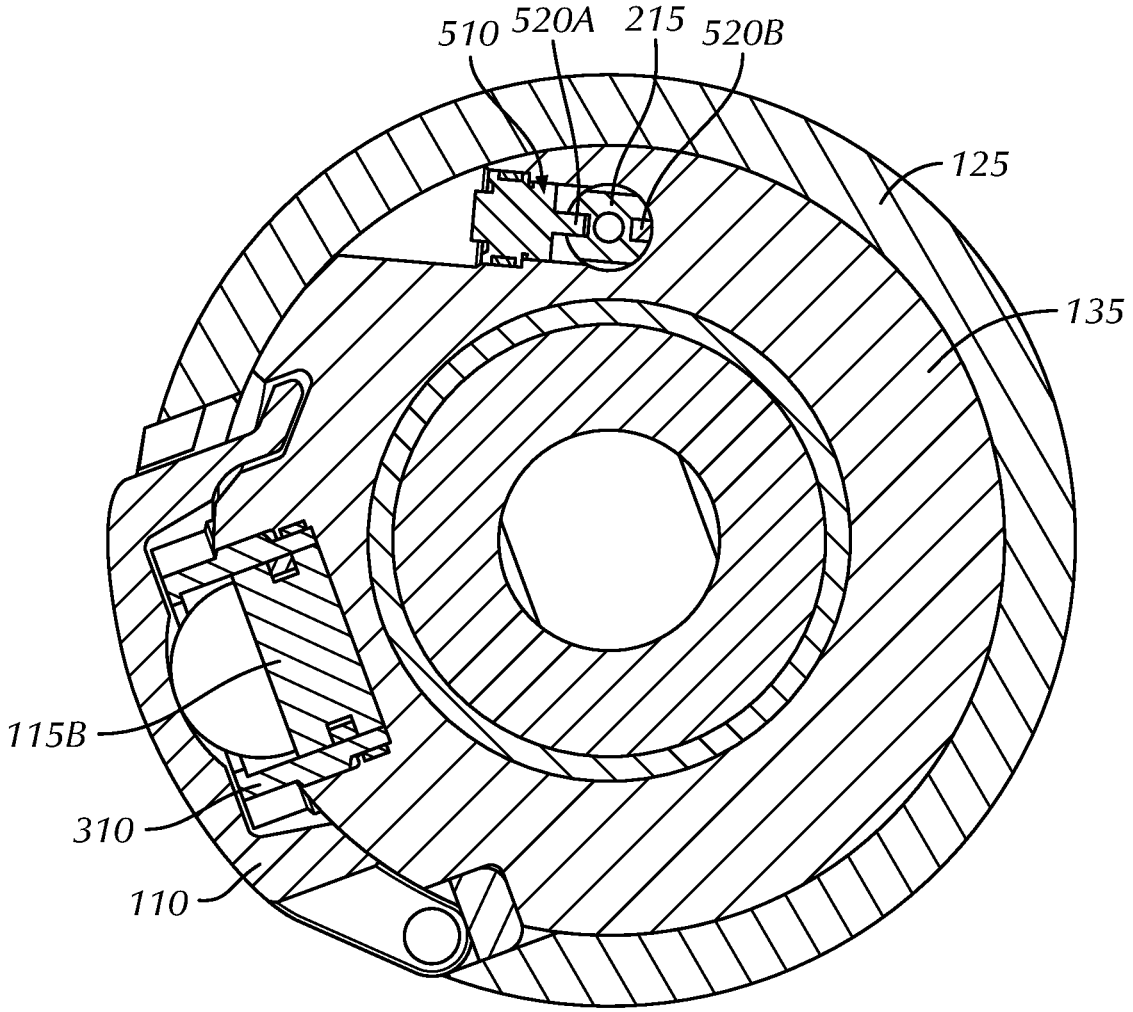
Figure 6:
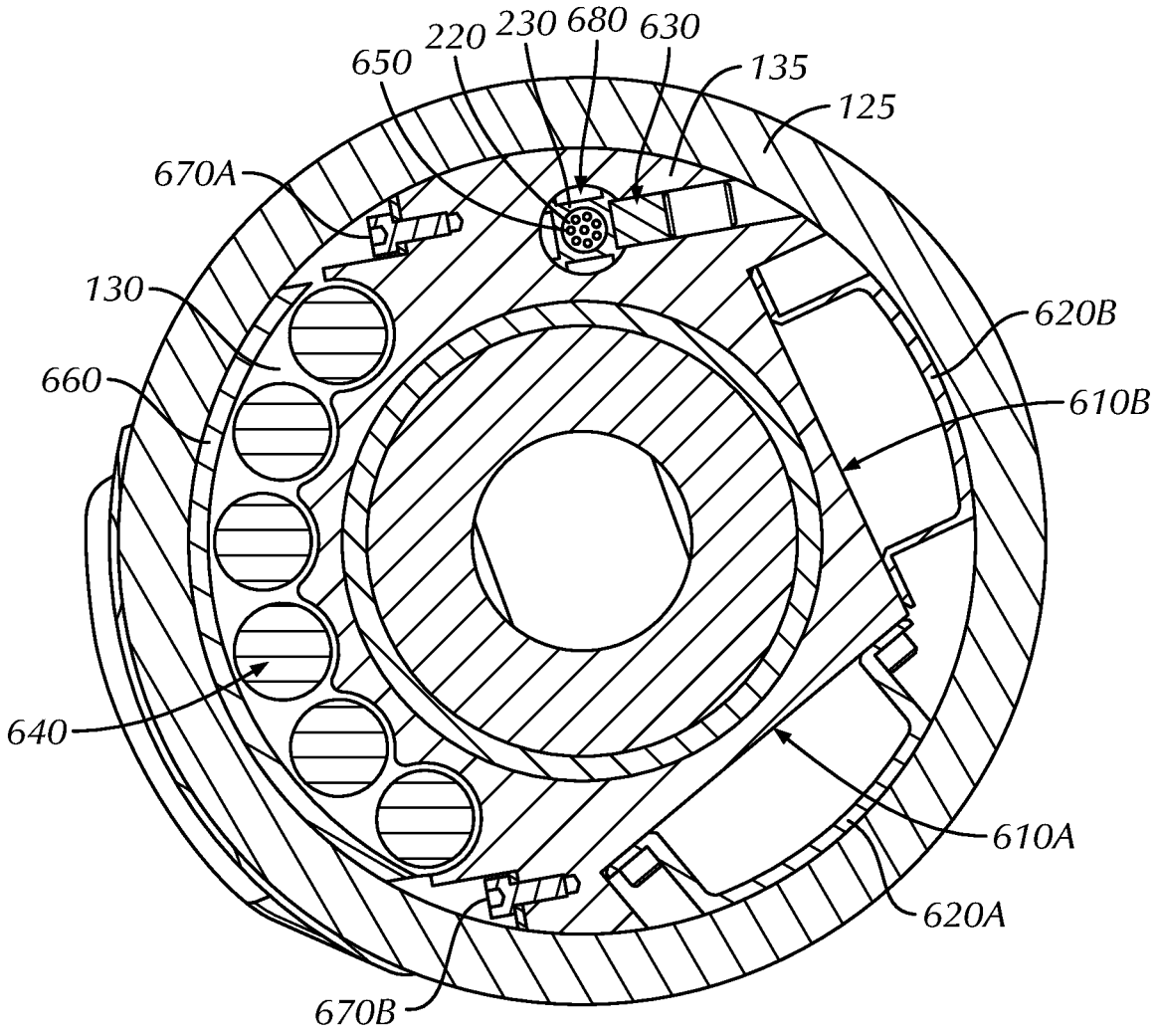

FIGS. 3-6 illustrate cross-sections of the variable build motor tool 100 at various lines D-D, F-F, G-G, and H-H according to various embodiments. FIG. 3 is a cross-section taken at line D-D, facing downhole. FIG. 4 is a cross-section taken at line H-H, facing uphole. FIG. 5 is a cross-section taken at line G-G, facing uphole. FIG. 6 is a cross-section taken at line F-F, facing uphole.

FIG. 3 provides more details about the arrangement of the pad 110 and the pistons 115. Because FIG. 3 is taken at line D-D, piston 115A is illustrated, but similar construction may be used for piston 115B. As illustrated in FIG. 4, a piston sleeve 310 holds the piston 115A in place, and makes a longer stroke length for the piston 115A. Other embodiments may omit the piston sleeve 310, which may limit the stroke length for piston 115A to less than the length allowed by use of piston sleeve 310.

Also illustrated in FIG. 3 is an oil pathway 320 allowing introduction of oil for use in pressurizing the piston system. Oil pathways 320 are typically drilled from the outside of the insert 135 before the insert 135 is disposed in outer housing 125. The oil pathways 320 move pressurized oil into piston chambers, which causes pistons 115 to extend, thus urging the pad 110 to extend, engaging the formation, and increasing the build rate of the drilling assembly.

FIG. 4 illustrates further details of the pad 110 and the ball screw assembly 210. As illustrated in FIG. 4, sealing piston 205 is held in place and prevented from rotation by an anti-rotation pin 410. A slot 450 is formed along one side of sealing piston 205, and anti-rotation pin 410 engages with the slot 450. In some embodiments, in addition to providing anti-rotation fixation of the ball screw assembly 210, the anti-rotation pin 410 may limit axial movement of the sealing piston 205, which may stop moving when an end of the slot 450 hits the anti-rotation pin 410. The anti-rotation pin 410 also supports thrust loads while the sealing piston 205 is in the closed position. The anti-rotation pin 410 is sealed to prevent pressurized oil from escaping out the pin hole drilled to allow placement of the anti-rotation pin 410. The ball screw assembly 210 may be attached to the sealing piston 205 through the use of a threaded connection or other similar mechanism. This attachment results in longitudinal movement of the sealing piston 205 and ball screw assembly 210 when the electric motor 215 is rotated.

Motor electronics may detect the movement stoppage, such as detecting an increase in current draw by the motor, and stop the motor from trying to extend or retract the ball screw assembly 210 further. This allows a simple mechanism for limiting how far the ball screw assembly 210 extends, without the need for the motor electronics to know the current position of the ball screw assembly 210, since the motor may simply be run until the stop is hit.

Action of the pad 110 according to one embodiment is also illustrated in FIG. 4. As illustrated, in one embodiment the pad is hinged at one end by hinge 440, so swings outward, rather than extending outward evenly, with the end toward the top of FIG. 4 extending out furthest. To control the amount of outward movement of the pad 110, a tab 420 may be formed on that end of the pad 110, which engages with a stop 430. The stop 430 may be positioned in the outer housing and configured for a predetermined maximum desired extension of the pad 110.

Turning now to FIG. 5, a similar anti-rotation pin 510 engages with one of slots 520A or 520B of electric motor 215 according to one embodiment. The anti-rotation pin 510 may be positioned in a hole drilled through the insert 135 similar to the anti-rotation pin 410 of FIG. 4, and is similarly sealed. The anti-rotation pin 510 is positioned prior to inserting the insert 135 into the outer housing 125.

The use of two slots 520 on opposite sides of the electric motor 215 allows easier engagement by the anti-rotation pin 510, since a maximum of 180° rotation would be required to align one of the slots 520 with the anti-rotation pin 510. However, other embodiments could use only a single slot 520. Other techniques for positioning and holding the electric motor 215 in place can be used. Pad 110, piston sleeve 310, and piston 115B are visible in this cross section taken at G-G.

FIG. 6, taken at line F-F, illustrates features related to the electronics section of the variable build motor tool 100 according to one embodiment. Circuitry (not illustrated in FIG. 6) configured to control the electric motor 215 may be mounted on surfaces 610A and 610B, then protective covers 620A, B may be mounted over the circuitry. Protective covers 620A, B may be made of aluminum or any other suitable material; any resulting cavities may subsequently be filled with potting material or any other suitable material. Although two mounting surfaces 610 and covers 620 are illustrated, any number of surfaces and covers may be used, subject to physical space constraints. Battery pack 130 as illustrated in FIG. 6 comprises 6 battery cells 640, which may be lithium or any other type of battery cells. A battery cover 660 may provide protection for the battery cells 640, and the battery pack 130 may be attached to the insert 135 using screws 670A, B or any other desired attachment mechanism.

FIG. 6 also illustrates the bulkhead 220 and bulkhead carrier 230, as well as the openings 650 for wires traversing the bulkhead 220. Slots 680 formed in the bulkhead carrier 230 allow a third anti-rotation pin 630 to affix the bulkhead carrier 230 (and thus the bulkhead 220) in place, preventing rotation and axial movement of the bulkhead carrier 230 and bulkhead 220. The third anti-rotation pin 630 may be inserted through a hole drilled through the insert 135 before the insert 135 is inserted into the outer housing 125.

Figure 7:
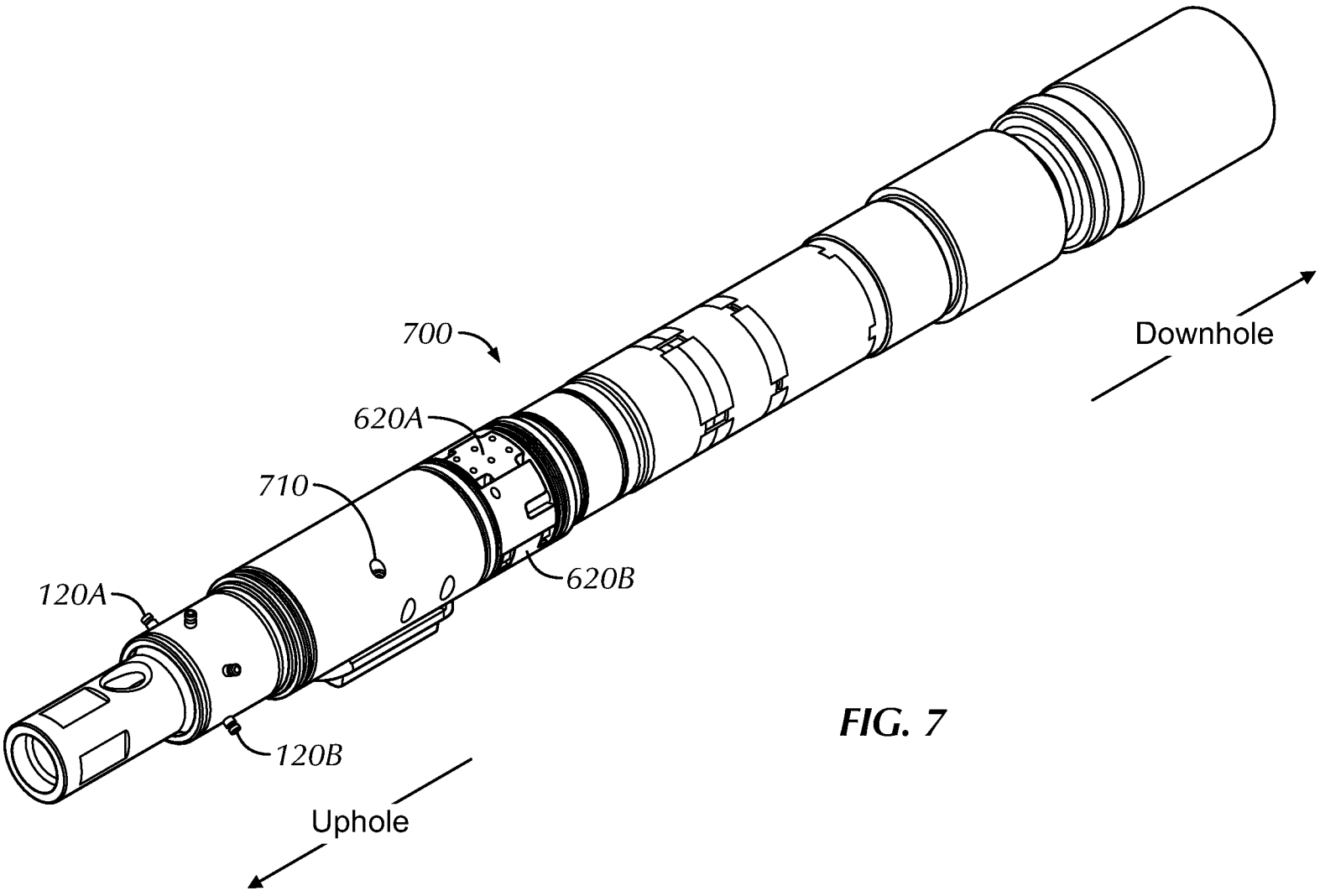
FIGS. 7-8 are isometric views of a variable build motor downhole tool according to one embodiment.
Figure 8:
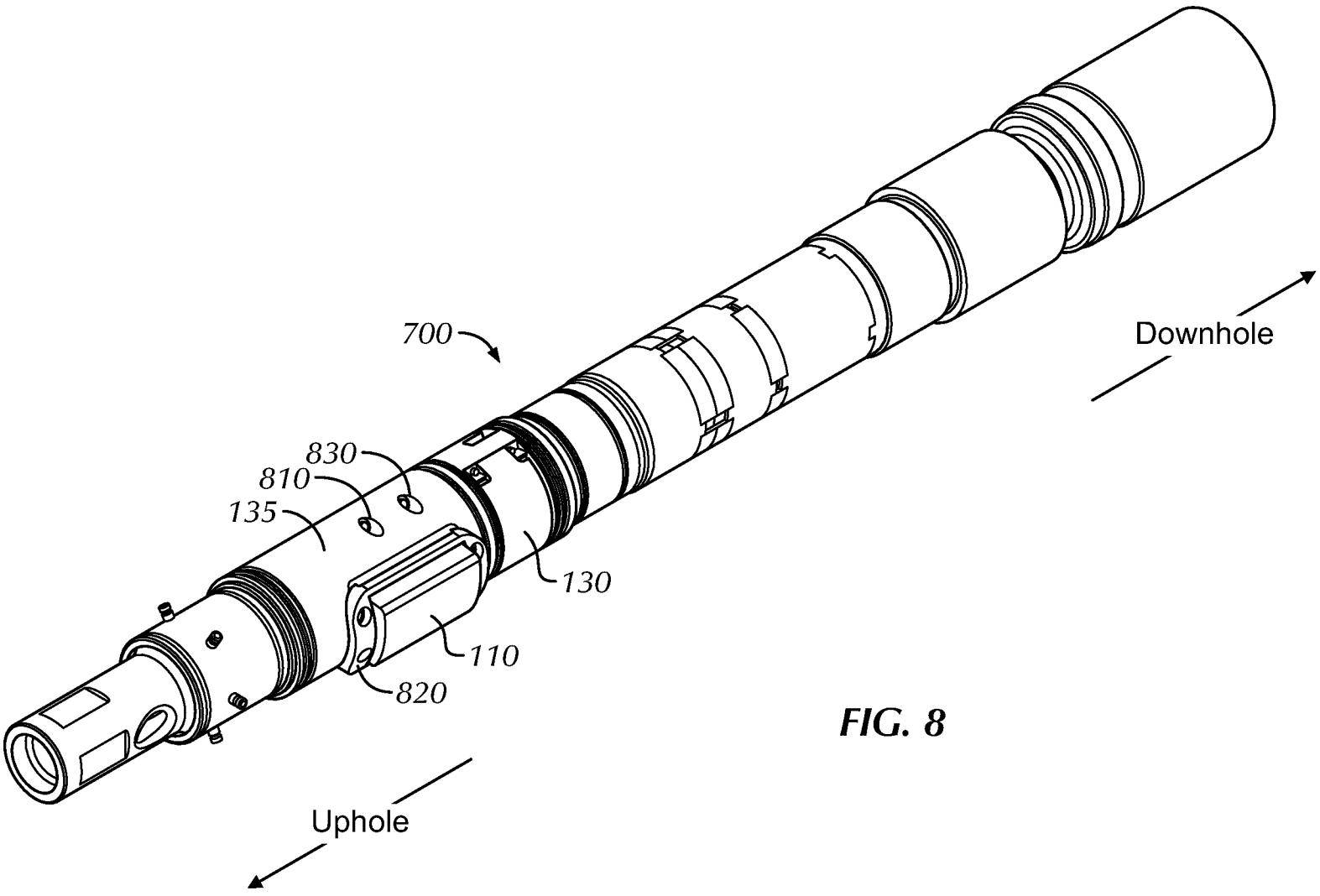

FIGS. 7 and 8 illustrate an assembled variable build motor tool 700 according to various embodiments except for the outer housing 125 of FIG. 1. In FIG. 7, screws 120A and 120B are illustrated, as well as other screws at different rotational positions around the variable build motor tool 700. In the illustrated embodiment six of the screws are used, but other numbers of screws may be used. The protective covers 620A and 620B are also visible in FIG. 7. Opening 710 is the opening to the oil pathway 320 of FIG. 3.

FIG. 8 illustrates the assembled variable build motor tool 700 at a different rotation, providing a better view of the pad assembly and the battery pack 130 from outside the tool. As illustrated in FIG. 8, the pad 110 is assembled with a plate structure 820 that is bolted to the insert 135. The plate structure 820 contains the hinge pin for the hinge 440 of FIG. 4, as well as the stop 430. The pad 110 and plate structure 820 may be pre-assembled and bolted or otherwise affixed onto the insert 135 through an opening in the outer housing 125, after the insert 135 is inserted into the outer housing 125. Opening 810 is an opening through which the anti-rotation pin 410 is inserted; opening 830 is a similar opening for insertion of anti-rotation pin 510.

By providing a movable pad 110 that can be activated downhole upon command, the variable build motor tool 100 allows a drilling operator to vary the build rate when desired, without tripping the drill string, with all of the costs, delays, and risks that are involved in that process, just to replace a sub with a different sub having a different amount of build rate.

While certain exemplary embodiments have been described in detail and shown in the accompanying drawings, such embodiments are merely illustrative of and not devised without departing from the basic scope thereof, which is determined by the claims that follow.

We claim:

1. A downhole tool for use in directional drilling, comprising:
- an outer housing having an opening;
- an insert disposed within the outer housing, comprising:
  - an oil chamber filled with oil;
  - a piston;
  - a pad disposed radially outward of the piston, wherein extension of the piston urges the pad outward through the opening of the outer housing for engagement with a wellbore and increasing build rate while drilling;
  - an electric motor, configured to cause extension of the piston; and
  - circuitry configured to control the electric motor upon receipt of a command received from uphole,
- wherein the electric motor allows oil pressure in the oil chamber to increase, responsive to the command, and
- wherein the piston urges the pad outward responsive to increased pressure in the oil chamber.

2. The downhole tool of claim 1, wherein the pad extends outward by rotating about a hinge.

3. The downhole tool of claim 1, wherein the insert further comprises:
- a stop configuring a maximum extension of the pad.

4. The downhole tool of claim 1, wherein the insert further comprises:
- a ball screw assembly, driven by the electric motor; and
- a sealing piston configured to seal the oil chamber, driven by the ball screw assembly.

5. The downhole tool of claim 1, wherein the insert further comprises:
- a piston sleeve, wherein the piston is disposed within the piston sleeve.

6. The downhole tool of claim 1, wherein the command comprises a sequence of changes in rotational speed.

7. The downhole tool of claim 1, wherein the command comprises a drilling fluid pressure pulse.

8. The downhole tool of claim 1, wherein the insert further comprises:
- a sealed bulkhead between the electric motor and the circuitry; and
- a bulkhead carrier affixed to the insert and holding the sealed bulkhead.

9. The downhole tool of claim 1, wherein the insert further comprises:
- a pair of slots on opposite sides of the electric motor; and
- an anti-rotation pin configured to prevent the electric motor from rotating within the insert when engaged with one of the pair of slots.

10. A method of changing build rate while directionally drilling, comprising:
- receiving by a downhole tool a first command to increase build rate from uphole;
- extending a pad outward from the downhole tool responsive to the first command, comprising:
  - driving a ball screw assembly by an electric motor, responsive to receiving the first command;
  - opening an oil chamber by the ball screw assembly;
  - extending a piston outward responsive to opening the oil chamber; and
  - urging the pad outward by the piston; and
- engaging the pad with a wellbore.

11. The method of claim 10, further comprising:
- receiving by the downhole tool a second command to decrease build rate from uphole; and
- allowing the pad to retract inward, disengaging the pad from the wellbore responsive to receiving the second command.

12. The method of claim 10, wherein the first command comprises a variation of rotational speed from a static rotational speed.

13. The method of claim 10, wherein the first command comprises a drilling fluid pressure pulse.

14. The method of claim 10, wherein extending the pad outward comprises:
- extending a piston responsive to receiving the first command, wherein the piston urges the pad outward.

15. The method of claim 10, wherein extending the pad outward comprises:

rotating the pad about a hinge on one side of the pad, causing an opposite side of the pad to extend outward.

16. The method of claim 15, further comprising:

limiting extension of the opposite side by a stop configured for a predetermined maximum extension.

17. The method of claim 10, further comprising:

stopping pumping of drilling fluid downhole reducing fluid pressure in the downhole tool; and allowing the pad to retract inward responsive to reducing fluid pressure in the downhole tool.

18. The method of claim 10, further comprising:

maintaining extension of the pad while drilling.

* * * * *